US006779741B2

(12) United States Patent
Boehland

(10) Patent No.: US 6,779,741 B2
(45) Date of Patent: Aug. 24, 2004

(54) FUEL INJECTION APPARATUS FOR AN INTERNAL COMBUSTION ENGINE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 102 days.

(21) Appl. No.: 10/290,508

(22) Filed: Nov. 8, 2002

(65) Prior Publication Data

US 2003/0111051 A1 Jun. 19, 2003

(30) Foreign Application Priority Data

Nov. 10, 2001 (DE) ..... 101 55 406

(51) Int. Cl.[7] ..... F02M 47/02

(52) U.S. Cl. ..... 239/88; 239/92; 239/96; 239/124; 123/446; 123/447

(58) Field of Search ..... 239/88, 90, 91, 239/92, 95, 96, 124, 533.2, 585.1; 123/446, 447, 467

(56) References Cited

U.S. PATENT DOCUMENTS 3,469,793 A * 9/1969 Guertler ..... 239/533.5
4,200,231 A * 4/1980 Knape ..... 239/94
6,527,198 B1 * 3/2003 Stoecklein ..... 239/102.2
6,634,336 B1 * 10/2003 Kropp ..... 123/467

* cited by examiner

*Primary Examiner*—Dinh Q. Nguyen
(74) *Attorney, Agent, or Firm*—Ronald E. Greigg

(57) ABSTRACT

For each cylinder of the internal combustion engine, the fuel injection apparatus has a high-pressure fuel pump and a fuel injection valve connected to it. A pump piston of the high-pressure fuel pump defines a pump working chamber, which is connected to a pressure chamber of the fuel injection valve, which has an injection valve member, which controls the injection openings and which the pressure prevailing in the pressure chamber can move in an opening direction, counter to a closing force. A first control valve controls a connection between the pump working chamber and a relief chamber, and a second control valve controls a connection between a relief chamber and a control pressure chamber connected to the pump working chamber. A control piston, which is connected to the injection valve member, divides the control pressure chamber into two separate partial chambers, which are connected to each other by means of a throttle restriction. When the second control valve is closed, a lower force acts on the control piston in a closing direction of the injection valve member than when the second control valve is open.

14 Claims, 3 Drawing Sheets

FUEL INJECTION APPARATUS FOR AN INTERNAL COMBUSTION ENGINE

BACKGROUND OF THE INVENTION

1. Field of the Invention

The invention is directed to an improved fuel injection apparatus for an internal combustion engine.

2. Description of the Prior Art

A fuel injection apparatus of the type with which this invention is concerned is known from EP 0 987 431 A2. This fuel injection apparatus has a high-pressure fuel pump and a fuel injection valve connected to it for each cylinder of the internal combustion engine. The high-pressure fuel pump has a pump piston, which the engine sets into a stroke motion and which defines a pump working chamber. The fuel injection valve has a pressure chamber connected to the pump working chamber and an injection valve member, which controls at least one injection opening and which the pressure prevailing in the pressure chamber can move in the opening direction, counter to a closing force, in order to open the at least one injection opening. A first electrically actuated control valve is provided, which controls a connection between the pump working chamber and a relief chamber. A second electrically actuated control valve is also provided, which controls a connection between a control pressure chamber and a relief chamber. The pressure prevailing in the control pressure chamber acts on the injection valve member at least indirectly in a closing direction and the control pressure chamber is connected to the pump working chamber. For an injection of fuel, the first control valve is closed and the second control valve is opened so that high pressure cannot build up in the control pressure chamber and the fuel injection valve can open. When the second control valve is open, however, fuel drains out of the pump working chamber by means of the control pressure chamber, so that of the fuel quantity delivered by the pump piston, the fuel quantity available for injection is reduced and so is the pressure available for the injection. As a result, the efficiency of the fuel injection apparatus is less than optimal.

OBJECT AND SUMMARY OF THE INVENTION

The fuel injection apparatus according to the invention has the advantage over the prior art that for the fuel injection, the second control valve can be closed so that no loss in fuel quantity and fuel pressure occurs during the injection, thus improving the efficiency of the fuel injection apparatus. By means of the throttle restriction, when the second control valve is open, the outflow of fuel into the relief chamber results in a pressure loss in one of the partial chambers of the control pressure chamber so that the control piston and by means of it, the injection valve member, has a greater force exerted on it in the closing direction than when the second control valve is closed, i.e. when at least approximately the same pressure prevails in both partial chambers.

Advantageous embodiments and modifications of the fuel injection apparatus according to the invention are disclosed. In a simple way, one embodiment makes it possible for less force to be exerted on the control piston in the closing direction when the second control valve is closed than when the second control valve is open. An advantageous configuration of the throttle restriction is also disclosed.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
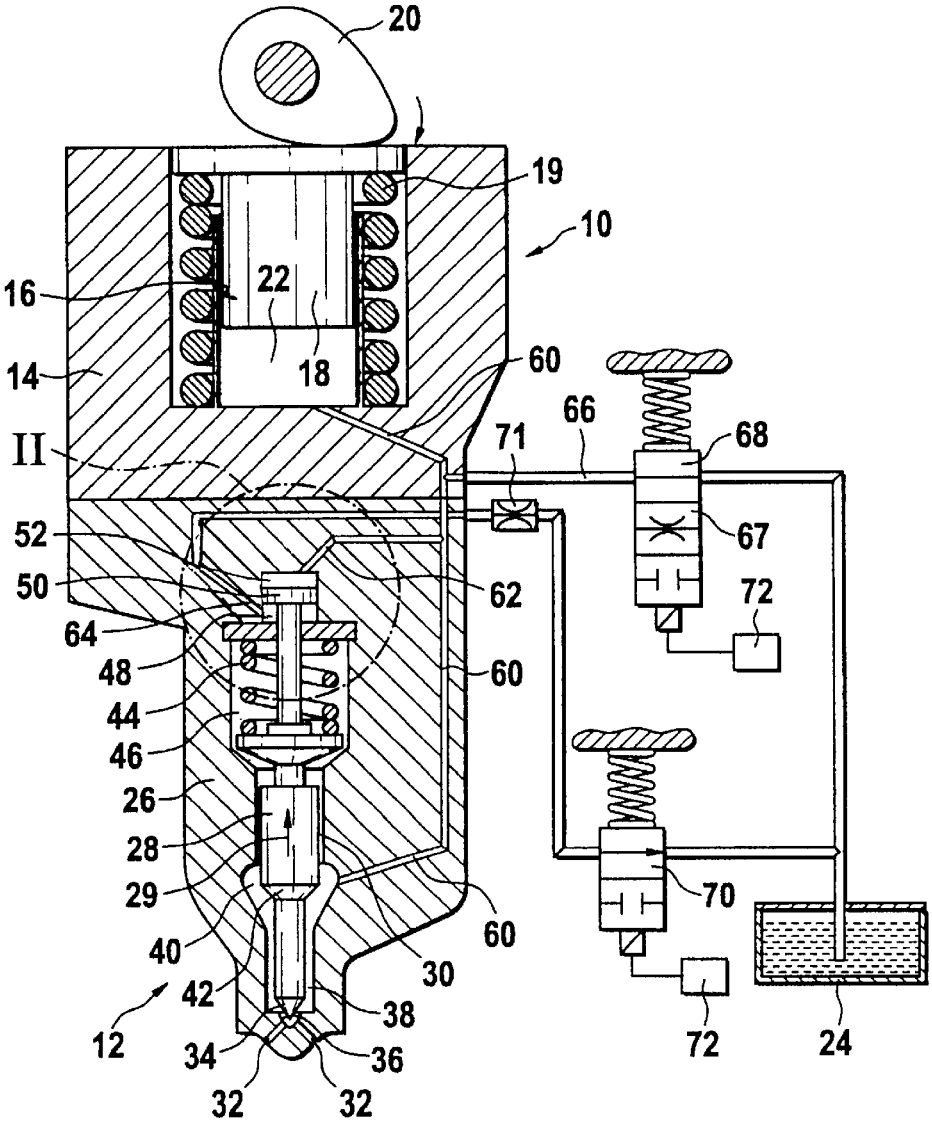
FIG. 1 schematically depicts a fuel injection apparatus for an internal combustion engine according to the invention.
Figure 2:
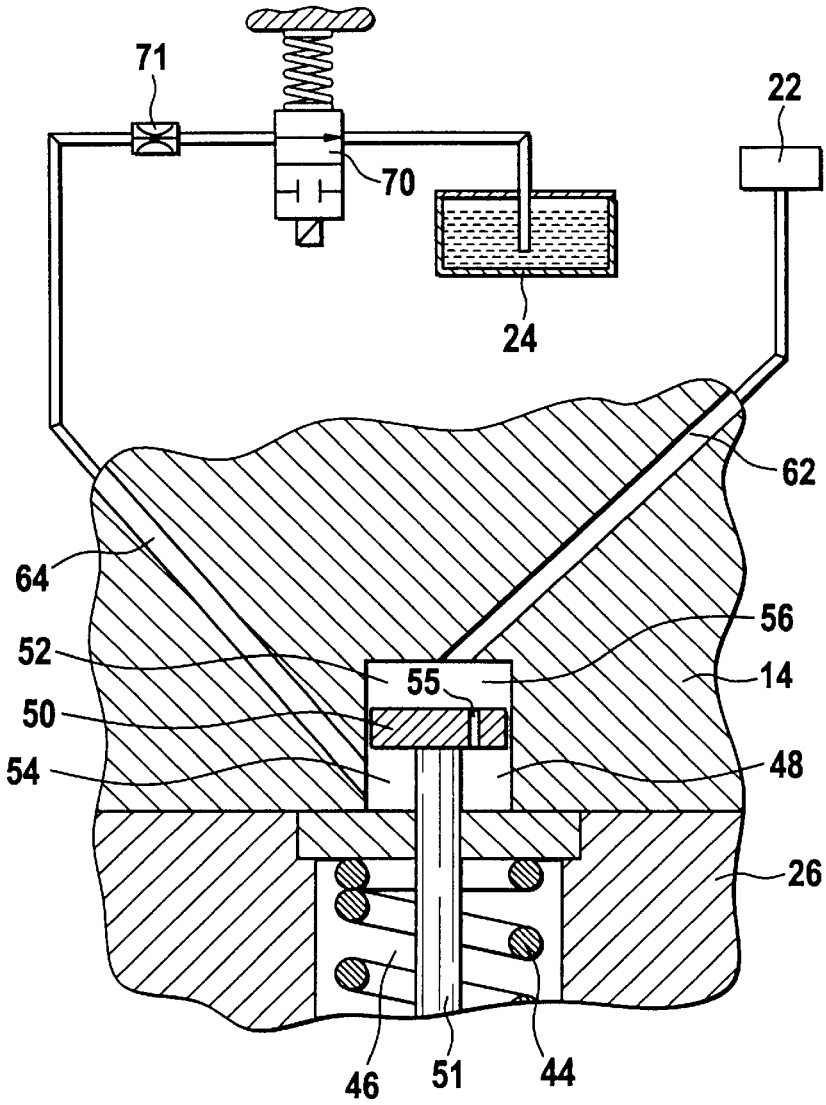
FIG. 2 shows an enlarged detail labeled II of the fuel injection apparatus shown in FIG. 1.

FIGS. 1 and 2 show a fuel injection apparatus for an internal combustion engine of a motor vehicle. The engine is preferably a compression-ignition engine. The fuel injection apparatus is preferably embodied as a so-called unit injector and for each cylinder of the engine, has a high-pressure fuel pump 10 and a fuel injection valve 12 connected to it, which form a combined component. Alternatively, the fuel injection apparatus can also be embodied as a so-called unit pump system in which the high-pressure fuel pump and the fuel injection valve of each cylinder are disposed separately from each other and are connected to each other by means of a line. The high-pressure fuel pump 10 has a pump body 14 with a cylinder bore 16, in which a pump piston 18 is guided in a sealed fashion, which is driven at least indirectly by a cam 20 of a camshaft of the engine to execute a stroke motion counter to the force of a restoring spring 19. In the cylinder bore 16, the pump piston 18 defines a pump working chamber 22 in which fuel is compressed under high pressure during the delivery stroke of the pump piston 18. The pump working chamber 22 is supplied with fuel from a fuel tank 24 of the motor vehicle.

The fuel injection valve 12 has a valve body 26, which is connected to the pump body 14 and can be comprised of several parts and in which an injection valve member 28 is guided so that it can move longitudinally in a bore 30. In its end region oriented toward the combustion chamber of the engine cylinder, the valve body 26 has at least one, preferably several, injection openings 32. In its end region oriented toward the combustion chamber, the injection valve member 28 has a for example approximately conical sealing surface 34 that cooperates with a valve seat 36, which is embodied in the valve body 26 in its end region oriented toward the combustion chamber, and the injection openings 32 lead away from this seat or branch off downstream of it. In the valve body 26, between the injection valve member 28 and the bore 30 toward the valve seat 36, there is an annular chamber 38, which in its end region oriented away from the valve seat 36, transitions by means of a radial expansion of the bore 30 into a pressure chamber 40 that encompasses the injection valve member 28. At the level of the pressure chamber 40, the injection valve member 28 has a pressure shoulder 42 produced by a cross sectional reduction. A prestressed closing spring 44 acts on the end of the injection valve member 28 oriented away from the combustion chamber and presses the injection valve member 28 toward the valve seat 36. The closing spring 44 is disposed in a spring chamber 46 of the valve body 26, which chamber adjoins the bore 30.

As depicted in FIG. 2, the end of the spring chamber 46 oriented away from the bore 30 in the valve body 26 is adjoined by another bore 48, which has a control piston 50 guided in it in a sealed fashion, which is connected to the injection valve member 28. The bore 48 constitutes a pressure control chamber 52, which the control piston 50 divides into two separate partial chambers 54, 56 that are sealed off from each other. With its end face oriented toward the injection valve member 28, the control piston 50 defines a first partial chamber 54 and with its end face oriented away from the injection valve member 28, the control piston 50 defines a second partial chamber 56 in the control pressure chamber 52. The control piston 50 is connected to the injection valve member 28 by means of a piston rod 51 whose diameter is smaller than that of the control piston 50. Because of the piston rod 51, the end surface area of the control piston 50 disposed in the first partial chamber 54 is somewhat smaller than the end surface area of the control piston 50 disposed in the second partial chamber 56. The control pressure chamber 52 is sealed in relation to the spring chamber 46. The two partial chambers 54, 56 are connected to each other by means of a throttle restriction 55, which is preferably disposed in the form of a bore in the control piston 50, but can alternatively also be disposed in a bypass extending outside the control pressure chamber 52.

A conduit 60 leads from the pump working chamber 22, through the pump body 14, and the valve body 26, to the pressure chamber 40 of the fuel injection valve 12. A conduit 62 leads from the pump working chamber 22 or from the conduit 60 to the control pressure chamber 52, which feeds into the second partial chamber 56. The first partial chamber 54 of the control pressure chamber 52 is connected to a conduit 64, which forms a connection to a relief chamber, which function can be at least indirectly fulfilled by the fuel tank 24 or another region in which a low pressure prevails. A connection 66 leads from the pump working chamber 22 or from the conduit 60 to a relief chamber 24 and this connection 66 is controlled by a first electrically actuated control valve 68. The control valve 68 can be embodied as a 2/2-port directional-control valve or, as shown in FIG. 1, as a 2/3-port directional-control valve. In the embodiment as a 2/3-port directional-control valve, the control valve 68 can be switched between three switched positions; the connection 66 is completely open in a first switched position, the connection 66 is open by means of a throttle restriction 67 in a second switched position, and the connection 66 is completely disconnected in a third switched position. The connection 64 of the control pressure chamber 52 to the relief chamber 24 is controlled by a second electrically actuated control valve 70, which can be embodied as a 2/2-port directional-control valve. A throttle restriction 71 can be provided in the connection of the first partial chamber 54 of the control pressure chamber 52 to the relief chamber 24. The control valves 68, 70 can have an electromagnetic actuator or a piezoelectric actuator and are activated by an electronic control device 72.

Figure 3:
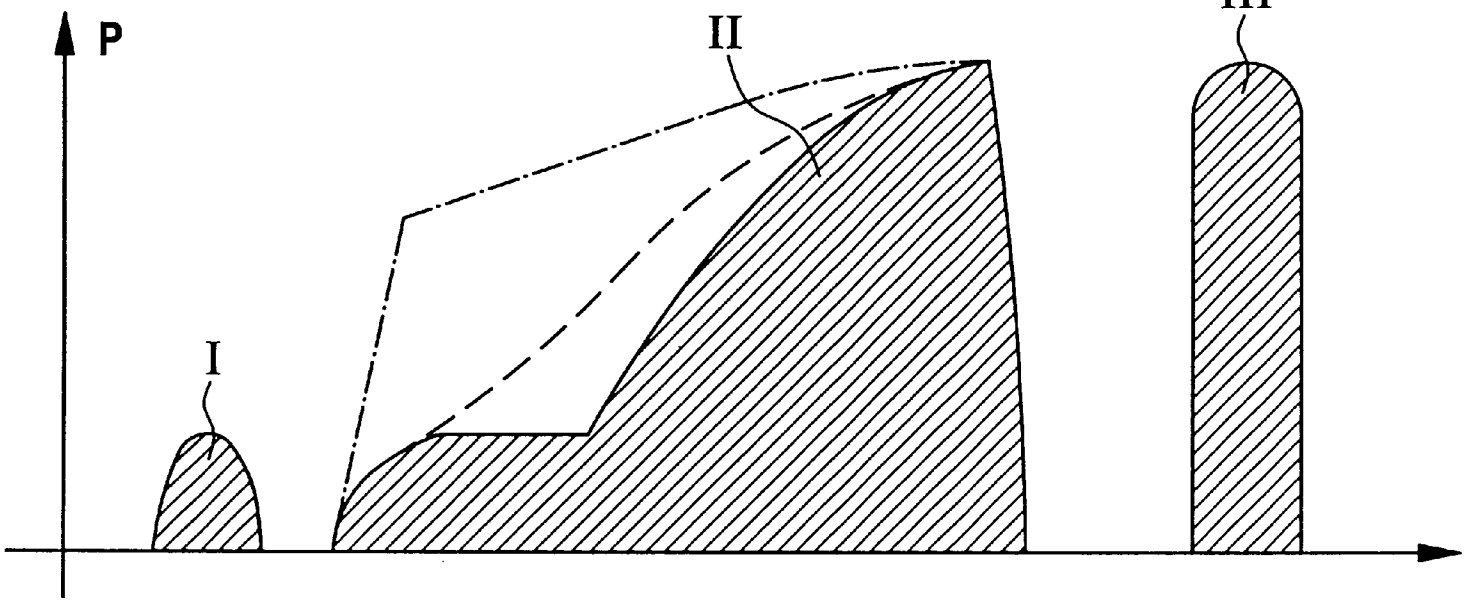
FIG. 3 shows a march of pressure at injection openings of a fuel injection valve of the fuel injection apparatus.

The function of the fuel injection apparatus will be explained below. FIG. 3 depicts the march of pressure p at the injection openings 32 of the fuel injection valve 12 over time t during an injection cycle. During the intake stroke of the pump piston 18, the pump is supplied with fuel from the fuel tank 24. During the delivery stroke of the pump piston 18, the fuel injection begins with a preinjection, in which the control device 72 brings the first control valve 68 into its second switched position or its third switched position so that the pump working chamber 22 is connected to the relief chamber 24 by means of the throttle restriction 67; the full high pressure according to the stroke motion of the pump piston 18 is not able to build up in the pump working chamber 22 in the second switched position, but is in fact able to build up in the third switched position. The control device 72 also closes the second control valve 70. In this case, no fuel can flow out of the control pressure chamber 52 into the relief chamber 24. Consequently, at least approximately the same pressure prevails in the two partial chambers 54, 56 of the control pressure chamber 52 so that a resulting force acts on the control piston 50 in the closing direction of the injection valve member 28 since the surface area of the control piston 50 acted on by the pressure in the second partial chamber 56 is greater than its surface area acted on by the pressure in the first partial chamber 54. This resulting compressive force on the control piston 50 acts in concert with the force of the closing spring 44 and acts on the injection valve member 28 by means of the piston rod 51. If the pressure in the pump working chamber 22 and therefore in the pressure chamber 40 of the fuel injection valve 12 is great enough that the compressive force that it exerts on the injection valve member 28 by means of the pressure shoulder 42 is greater than the sum of the force of the closing spring 44 and the compressive force acting on the control piston 50, then the injection valve member 28 moves in the opening direction 29 and unblocks the at least one injection opening 32. During the fuel injection, fuel only flows from the pump working chamber 22 into the pressure chamber 40 and via the throttle restriction 67 into the relief chamber 24, but not via the control pressure chamber 52 into the relief chamber 24. The preinjection corresponds to an injection phase labeled I in FIG. 3. In order to terminate the preinjection, the control device brings the first control valve 68 into its first, completely open switched position and/or brings the second control valve 70 into its open switched position.

If the second control valve 70 is open, then fuel flows out of the pump working chamber 22, through the control pressure chamber 52, and into the relief chamber 24. The fuel thus flows through the throttle restriction 55, which produces a pressure drop, so that a lower pressure prevails in the first partial chamber 54 of the control pressure chamber 42 than in the second partial chamber 56. Consequently, a greater resulting compressive force acts on the control piston 50 in the closing direction of the injection valve member 28 than when the second control valve 70 is closed. The sum of the resulting compressive force acting on the control piston 50 and the force of the closing spring 44 is greater than compressive force that the pressure prevailing in the pressure chamber 40 exerts on the injection valve member 28 so that the fuel injection valve 12 closes.

For a subsequent main injection, which corresponds to an injection phase labeled II in FIG. 3, the control device 72 closes the second control valve 70. The invention can include the provision that the control device 72 initially brings the first control valve 68 into its second open position so that the connection 66 of the pump working chamber 22 to the relief chamber 24 via the throttle restriction 67 is open. The main injection then begins at a reduced pressure level, as depicted with a solid line in FIG. 3. At a later point in time, the control device 72 brings the first control valve 68 into its third, completely closed switched position so that the pump working chamber 22 is disconnected from the relief chamber 24 and the fuel injection takes place at a high pressure.

Alternatively, the invention can also provide that the control device 72 already brings the first control valve 68 into its third, completely closed switched position at the beginning of the main injection so that the fuel injection takes place at a high pressure, as depicted with the dashed line in FIG. 3. Alternatively, the control device 72 can already close the second control valve 70 at the beginning of the main injection. In this case, a march of pressure occurs, which is depicted with a dot-and-dash line in FIG. 3.

In order to terminate the main injection, the control device 72 moves the second control valve 70 into its open switched position so that a greater force acts on the control piston 50 in the closing direction and the fuel injection valve 12 closes. The first control valve 68 remains in its third switched position. For a secondary injection, the control device 72 closes the second control valve 70 again so that a lower force acts on the control piston 50 in the closing direction and the fuel injection valve 12 opens. The secondary injection corresponds to an injection phase labeled III in FIG. 3 and occurs at a high pressure. In order to terminate the secondary injection, the control device 72 brings the first control valve 68 into its first, completely open switched position and brings the second control valve 70 into its open switched position.

The foregoing relates to preferred exemplary embodiments of the invention, it being understood that other variants and embodiments thereof are possible within the spirit and scope of the invention, the latter being defined by the appended claims.

I claim:

1. A fuel injection apparatus for an internal combustion engine, comprising a high-pressure fuel pump (10) and a fuel injection valve (12) connected to a high pressure pump for each cylinder of the engine, the high-pressure fuel pump (10) having a pump piston (18), which the engine sets into a stroke motion and which defines a pump working chamber (22), the working chamber being supplied with fuel from a fuel tank (24), which also is a relief chamber (24), the fuel injection valve (12) having a pressure chamber (40) connected to the pump working chamber (22) and an injection valve member (28) which controls at least one injection opening (32) and which the pressure prevailing in the pressure chamber (40) can move in an opening direction (29), counter to a closing force, in order to unblock the at least one injection opening (32), a first control valve (68) that controls a connection (66) between the pump working chamber (22) and the relief chamber (24), a second control valve (70) that controls a connection (64) between a control pressure chamber (52) of the fuel injection valve and the relief chamber (24), wherein the pressure prevailing in the control pressure chamber (52) at least indirectly acts on the injection valve member (28) and the control pressure chamber (52) is connected to the pump working chamber (22), and a control piston (50) contained in the control pressure chamber (52), the control piston (50) being connected to the injection valve member (28) and dividing the control pressure chamber (52) into two separate partial chambers (54, 56) that are connected to each other via a throttle restriction (55), whereby, that when the second control valve (70) is closed and the control pressure chamber (52) is disconnected from the relief chamber (24), a lower pressure acts on the control piston (50) in a closing direction of the injection valve member (28) than when the second control valve (70) is open.

2. The fuel injection apparatus according to claim 1 wherein on one end of the control piston (50) is acted on in the opening direction (29) of the injection valve member (28) by the pressure prevailing in a first partial chamber (54) and an other end of the control piston (50) is acted on in a closing direction of the injection valve member (28) by the pressure prevailing in a second partial chamber (56), wherein the connection (64) of the first control pressure chamber (52) to the relief chamber (24) feeds into the first partial chamber (54), and wherein the connection (62) of the control pressure chamber (52) to the pump working chamber (22) feeds into the second partial chamber (56).

3. The fuel injection apparatus according to claim 2 wherein the throttle restriction (55) is disposed in the control piston (50).

4. The fuel injection apparatus according to claim 3 wherein the first partial chamber (54) of the control pressure chamber (52) is disposed oriented toward the injection valve member (28) and the second partial chamber (56) of the control pressure chamber (52) is disposed oriented away from the injection valve member (28).

5. The fuel injection apparatus according to claim 4 wherein the control piston (50) is connected as a separate part to the injection valve member (28) by means of a piston rod (51) whose cross section is smaller than that of the control piston (50).

6. The fuel injection apparatus according to claim 3 wherein the control piston (50) is connected as a separate part to the injection valve member (28) by means of a piston rod (51) whose cross section is smaller than that of the control piston (50).

7. The fuel injection apparatus according to claim 2 wherein the first partial chamber (54) of the control pressure chamber (52) is disposed oriented toward the injection valve member (28) and the second partial chamber (56) of the control pressure chamber (52) is disposed oriented away from the injection valve member (28).

8. The fuel injection apparatus according to claim 7 wherein the control piston (50) is connected as a separate part to the injection valve member (28) by means of a piston rod (51) whose cross section is smaller than that of the control piston (50).

9. The fuel injection apparatus according to claim 2 wherein the control piston (50) is connected as a separate part to the injection valve member (28) by means of a piston rod (51) whose cross section is smaller than that of the control piston (50).

10. The fuel injection apparatus according to claim 1 wherein the throttle restriction (55) is disposed in the control piston (50).

11. The fuel injection apparatus according to claim 10 wherein the first partial chamber (54) of the control pressure chamber (52) is disposed oriented toward the injection valve member (28) and the second partial chamber (56) of the control pressure chamber (52) is disposed oriented away from the injection valve member (28).

12. The fuel injection apparatus according to claim 11 wherein the control piston (50) is connected as a separate part to the injection valve member (28) by means of a piston rod (51) whose cross section is smaller than that of the control piston (50).

13. The fuel injection apparatus according to claim 10 wherein the control piston (50) is connected as a separate part to the injection valve member (28) by means of a piston rod (51) whose cross section is smaller than that of the control piston (50).

14. The fuel injection apparatus according to claim 1 wherein the control piston (50) is connected as a separate part to the injection valve member (28) by means of a piston rod (51) whose cross section is smaller than that of the control piston (50).

* * * * *